US006933830B2

(12) United States Patent
Ikeda

(10) Patent No.: US 6,933,830 B2
(45) Date of Patent: Aug. 23, 2005

(54) VARIABLE RESISTOR

(75) Inventor: Kazuyuki Ikeda, Sabae (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/735,765

(22) Filed: Dec. 16, 2003

(65) Prior Publication Data

US 2004/0183649 A1 Sep. 23, 2004

(30) Foreign Application Priority Data

Mar. 17, 2003 (JP) ..... 2003-071941

(51) Int. Cl.[7] ..... H01C 10/32

(52) U.S. Cl. ..... 338/162; 338/163; 338/174; 338/202

(58) Field of Search ..... 338/162, 163, 338/166, 167, 168, 174, 202

(56) References Cited

U.S. PATENT DOCUMENTS 2,706,760 A * 4/1955 Mucher ..... 338/202
4,429,297 A * 1/1984 Nakatsu ..... 338/162
4,785,277 A * 11/1988 Yashiro ..... 338/162
4,785,278 A * 11/1988 Nishizawa et al. ..... 338/162
5,134,383 A * 7/1992 Ueda ..... 338/162
5,293,525 A * 3/1994 Yoshimura ..... 338/162
5,315,283 A * 5/1994 Yoshimura ..... 338/162
5,500,634 A * 3/1996 Ueda ..... 338/174
5,592,141 A * 1/1997 Castellano Aldave ..... 338/162
6,317,022 B2 * 11/2001 Doi ..... 338/162
6,380,841 B2 * 4/2002 Masuda et al. ..... 338/163

FOREIGN PATENT DOCUMENTS

JP 2001-015308 1/2001
JP 2002-231512 8/2002

* cited by examiner

*Primary Examiner*—Karl D. Easthom
(74) *Attorney, Agent, or Firm*—Keating & Bennett, LLP

(57) ABSTRACT

A variable resistor is configured such that a contact of a contact arm is prevented from contacting a driver plate even when the height of a disk section of a sliding contact is reduced so as to reduce the height of the variable resistor. A sliding contact includes an annular driver plate disposed on the top surface, a disk section folded from the external periphery of the driver plate to the back side, and the semi-circular contact arm provided in the external periphery of the disk section opposite to the folded portion. In the external periphery of the driver plate opposite to the folded portion on the back surface thereof, i.e., in a portion of the disk section folded to the back side of the driver plate opposing the contact of the contact arm, a step is provided such that a gap between the driver plate and the contact arm is increased.

16 Claims, 11 Drawing Sheets

VARIABLE RESISTOR

BACKGROUND OF THE INVENTION

1. Field of the Invention

The present invention relates to a variable resistor for use in various electronic components.

2. Description of the Related Art

A conventional variable resistor is disclosed in Japanese Unexamined Patent Application Publication No. 2001-15308. As shown in FIG. 11A, this variable resistor includes an insulating substrate 51 having a substantially semi-circular resistor 58 provided on the surface and a sliding contact 56 rotatably attached to the insulating substrate 51.

Into the insulating substrate 51, metallic terminals 52 and 53 are insert-molded. The sliding contact 56 includes a driver plate 56*b* rotationally operated by a tool, such as a screwdriver, and a body formed by folding the driver plate 56*b* from the external edge to the backside. The body includes a contact arm 56*a* sliding over the resistor 58 and a disk section 56*c* supporting the contact arm 56*a*. The sliding contact 56 is rotatably attached to the insulating substrate 51 by caulking the disk section 56*c*.

A conventional variable resistor having a ceramic substrate as the insulating substrate is disclosed in Japanese Unexamined Application Publication No. 2002-231512.

Previously, the variable resistors disclosed in Japanese Unexamined Application Publication No. 2001-15308 and Japanese Unexamined Application Publication No. 2002-231512 have been required to reduce the height thereof, and to reduce the height, the height of the disk section 56*c* of the sliding contact 56 is reduced.

However, as shown in FIG. 11B, if only the height of the disk section 56*c* is reduced, the gap d between the top surface of the insulating substrate 51 and the sliding contact 56 is reduced. That is, the gap t between the contact arm 56*a* and the driver plate 56*b* is reduced. Therefore, a contact 56*d* of the contact arm 56*a* is likely to contact the driver plate 56*b* due to manufacturing errors or deflection in use. When the contact arm 56*a* is brought into contact with the driver plate 56*b*, the contact pressure of the contact 56*d* to the rotator 58 is changed, which results in fluctuations of the characteristics thereof (variations in resistance). If the contact 56*d* contacts the rotator 58 with a large amount of pressure, the rotator 58 may be damaged.

SUMMARY OF THE INVENTION

To overcome the problems described above, preferred embodiments of the present invention provide a variable resistor in which contact between a contact arm and a driver plate is prevented even if the height of a disk section of a sliding contact is reduced so as to reduce the height of the variable resistor.

A variable resistor according to a preferred embodiment of the present invention includes an insulating substrate having a substantially arch-shaped resistor provided on a surface thereof, and a sliding contact rotatably attached to the insulating substrate, wherein the sliding contact includes a body including a contact arm sliding over the resistor and a disk section for supporting the contact arm and a driver plate overlapping the body for being operated by a tool, and wherein a step is disposed on a surface having the contact arm provided thereon and at a position of the contact arm opposing a contact such that a gap between the driver plate and the contact arm is increased.

According to preferred embodiments of the present invention, since the step increases the gap between the driver plate and the contact arm, even if the height of the sliding contact is reduced to reduce the height of the variable resistor, the contact arm does not contact the driver plate. Accordingly, contact between the driver plate and the contact arm caused by errors in manufacturing the sliding contact and the insulating substrate is prevented. As a result, the contact pressure between the contact of the contact arm and the resistor is stabilized, which suppresses fluctuations in electrical characteristics (changes in resistance). The step is preferably formed by folding the driver plate or by providing a recess in the driver plate. However, when the step is formed by the folding, since the height of the variable resistor is partially increased, it is preferable to form the step by providing the recess.

The above and other elements, characteristics, features, steps and advantages of the present invention will become clear from the following description of preferred embodiments taken in conjunction with the accompanying drawings.

DETAILED DESCRIPTION OF PREFERRED EMBODIMENTS

Preferred embodiments of a variable resistor according to the present invention will be described below with reference to the attached drawings.

First Preferred Embodiment

Figure 1:
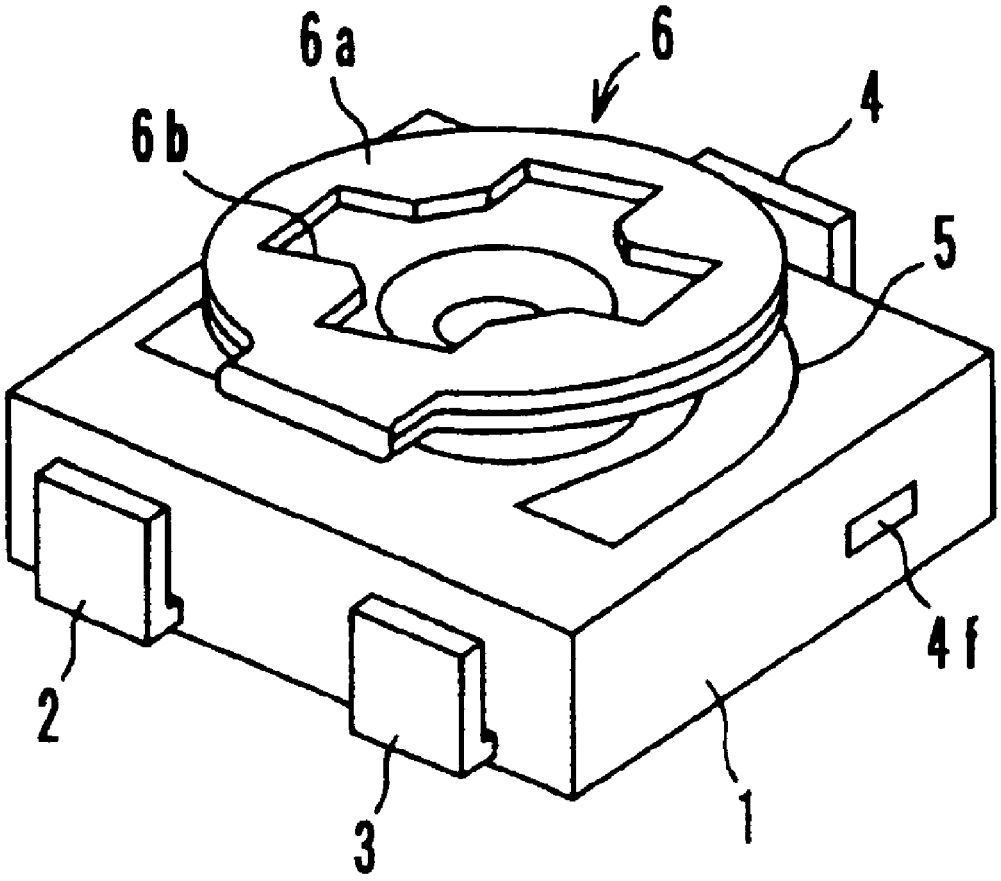
FIG. 1 is an external perspective view of a variable resistor according to a first preferred embodiment of the present invention.
Figure 2:
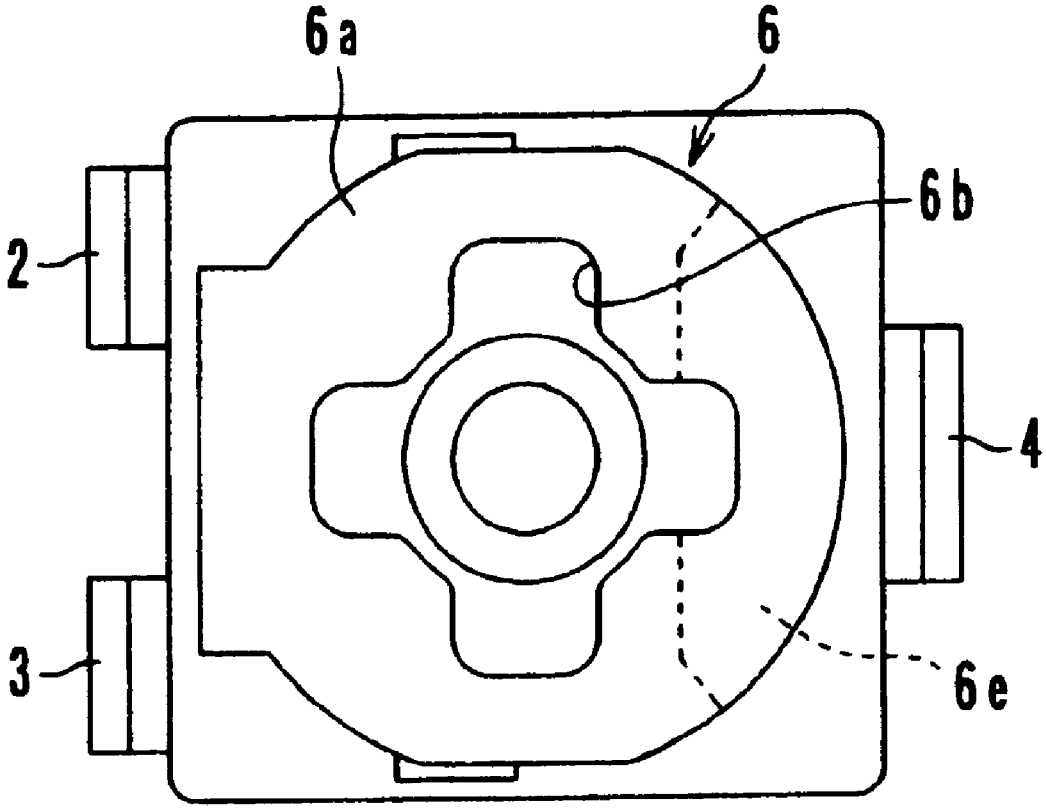
FIG. 2 is a plan view of the variable resistor shown in FIG. 1.
Figure 3:
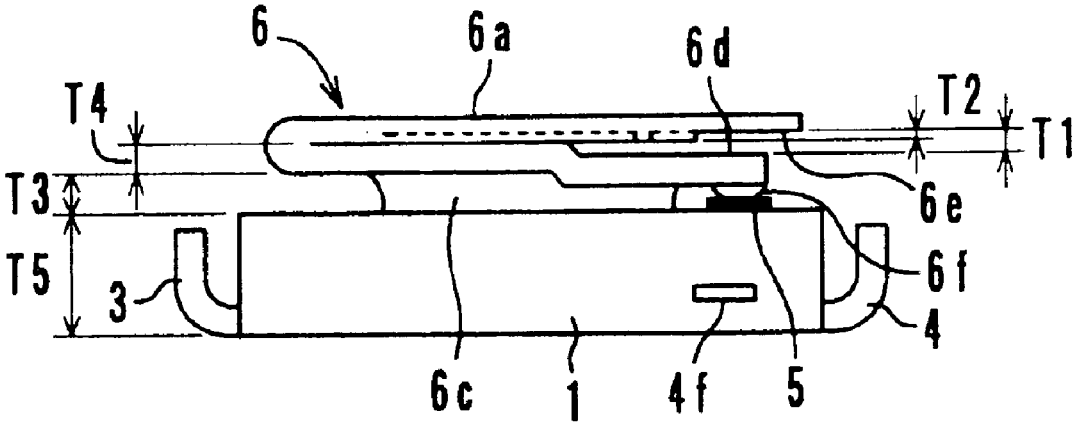
FIG. 3 is a side view of the variable resistor shown in FIG. 1.

FIGS. 1 to 3 are an external perspective view, a plan view, and a side view of a variable resistor, respectively. The variable resistor includes an insulating substrate 1 having metallic stationary-side terminals 2 and 3 and a metallic variable-side terminal 4, which are integrally insert-molded, and a metallic sliding contact 6 attached to the variable-side terminal 4 by caulking.

Figure 4:
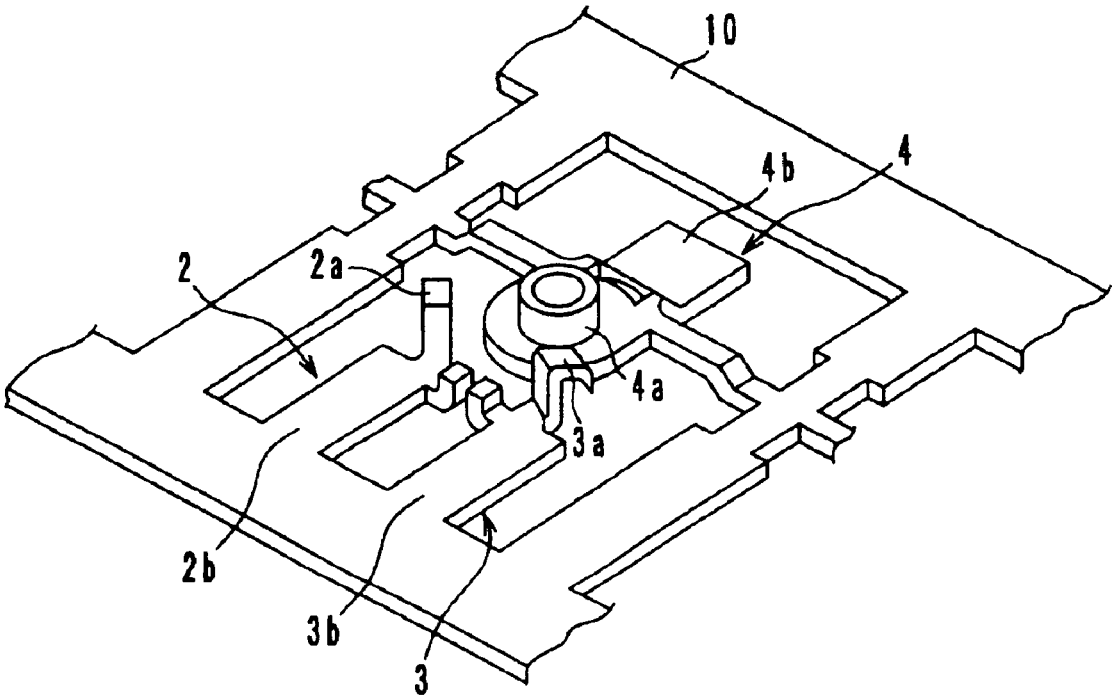
FIG. 4 is a perspective view of an example of a manufacturing process of an insulating substrate shown in FIG. 1.
Figure 5:
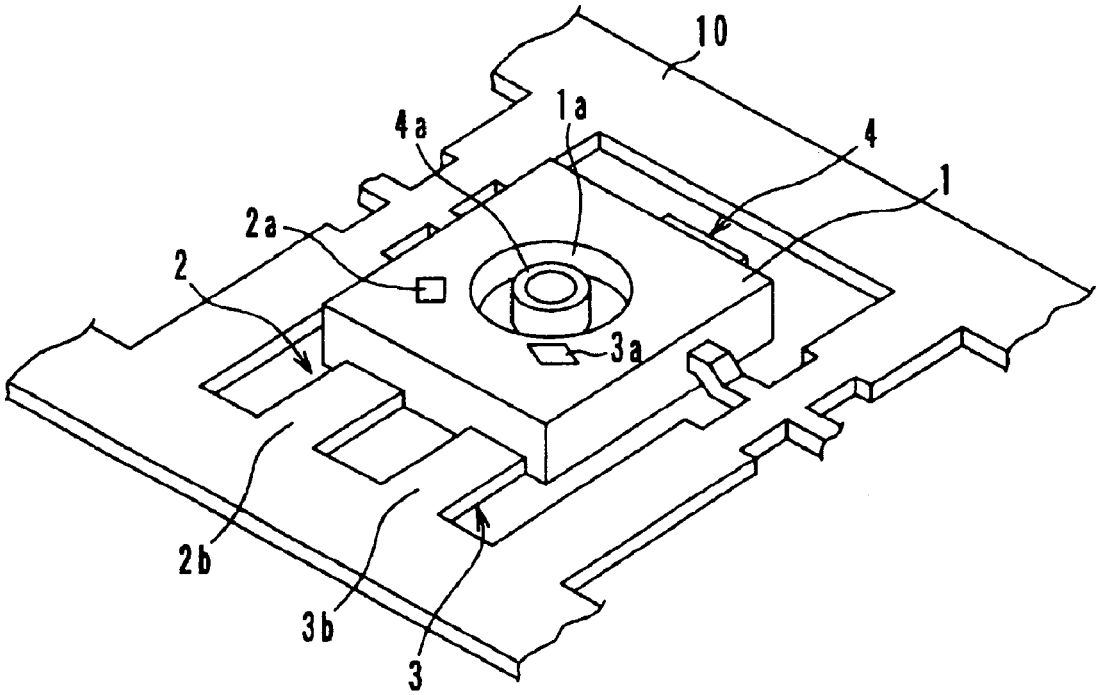
FIG. 5 is a perspective view of the manufacturing process continued from FIG. 4.

After the stationary-side terminals 2 and 3 and the variable-side terminal 4, which are attached to a coil strip 10, as shown in FIG. 4, are insert-molded with a resin as shown in FIG. 5, the insulating substrate 1 is formed by cutting the molded product off the coil strip 10. As the resin, a heat-resistant thermoplastic resin or a thermo-setting resin is used so as to resist heat from soldering and so as to enable stable operation at high temperature. For example, a liquid crystal (LPC) resin, modified nylon 6T, a polyphenylene sulfide (PPS) resin, a polyester resin, an epoxy resin, and a diallylphthalate resin may be used. Other suitable materials may also be used.

On the top surface of the insulating substrate 1, conduction portions 2*a* and 3*a* of the stationary-side terminals 2 and 3 are exposed. External connection portions 2*b*, 3*b*, and 4*b*, which are soldering portions for soldering the stationary-side terminals 2 and 3 and the variable-side terminal 4 to a printed circuit board, respectively, extend from the bottom surface of the insulating substrate 1 and folded upward along side surfaces of the insulating substrate 1. The top surface of the insulating substrate 1 is coated with carbon (see FIG. 7) in a substantially arch-shaped arrangement so as to cover the conduction portions 2*a* and 3*a* of the stationary-side terminals 2 and 3.

The carbon is dried so as to form a resistor 5, which electrically connects the resistor 5 to the stationary-side terminals 2 and 3. At one end of the variable-side terminal 4, a cylindrical eyelet part 4*a* is integrally formed and exposed from a central hole 1*a* of the insulating substrate 1. The stationary-side terminals 2 and 3 and the variable-side terminal 4 are made of a highly conductive thin plate, such as those made of a copper alloy and stainless steel. To improve solder wettability, at least surfaces of the conduction portions 2*a*, 3*b*, and 4*b* are made by noble metal plating, such as plating of gold or silver, solder plating, and tin plating.

Figure 6:
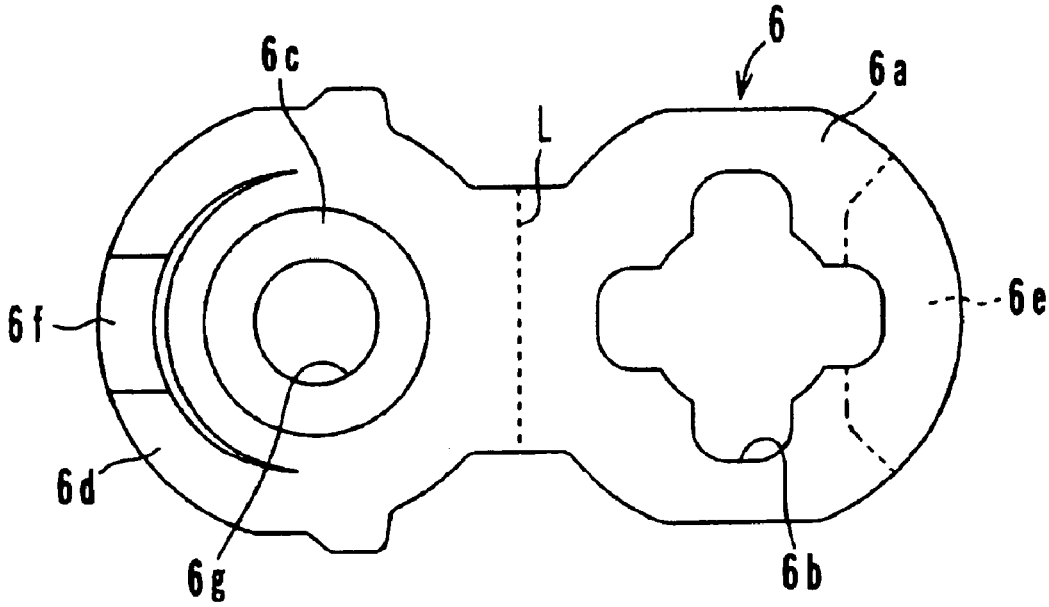
FIG. 6 is an expansion plan view of a sliding contact shown in FIG. 1.

As shown in FIG. 6, a sliding contact 6 includes an annular driver plate 6*a*, which is a top surface, a disk section 6*c* folded from an external edge of the driver plate 6*a* backward along a dotted line L, and a semi-circular contact arm 6*d* provided in an external edge of the disk section 6*c* opposite to the folded portion thereof. The sliding contact 6 is formed by punching and drawing one metallic plate.

At the approximate center of the driver plate 6*a*, a cross-shaped engagement hole (adjustment hole) 6*b* is provided for being operated by a tool, such as a screwdriver. Furthermore, a step 6*e* is disposed at an external edge of the back surface of the driver plate 6*a* opposite to the folded portion, i.e., at a location in the disk section 6*c* that is folded to the back surface of the driver plate 6*a* and opposing a contact 6*f* of the contact arm 6*d*, such that a gap between the driver plate 6*a* and the contact arm 6*d* is increased.

The contact arm 6*d* having a spring property is provided with the protruding contact 6*f* provided at the approximate center. The contact 6*f* is brought into contact with the resistor 5 of the insulating substrate 1 so as to slide thereon.

Figure 7:
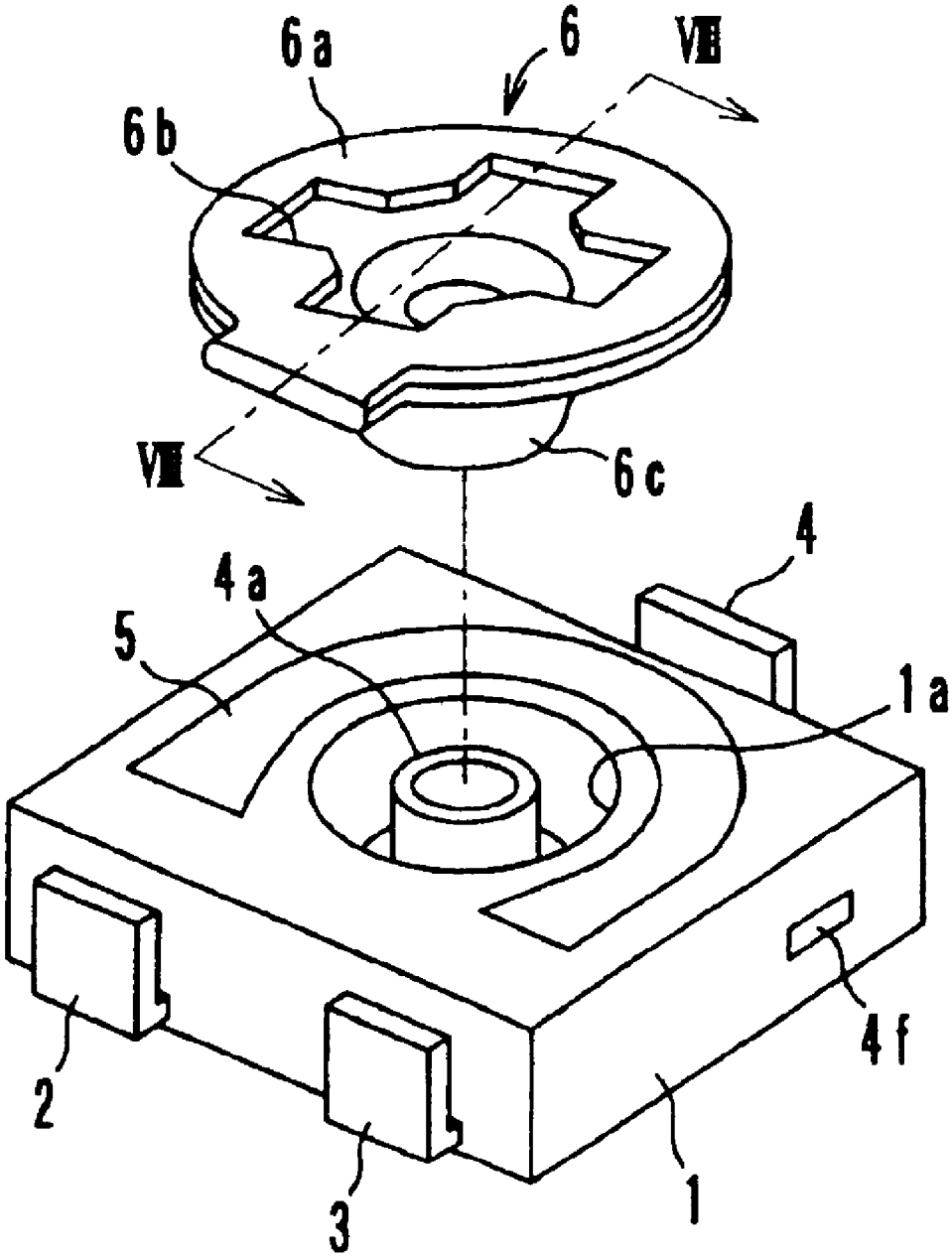
FIG. 7 is a perspective assembly view of the variable resistor shown in FIG. 1.
Figure 8:
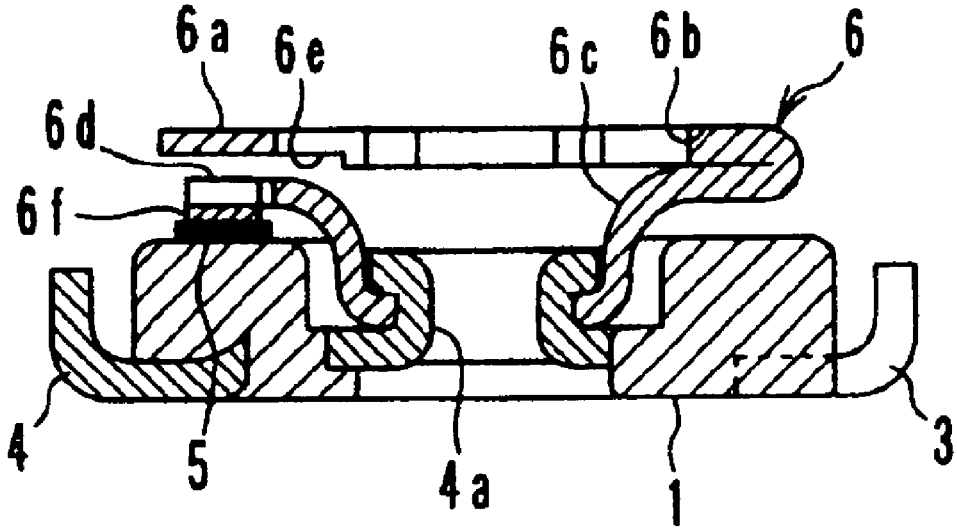
FIG. 8 is a sectional view at the line VIII—VIII of FIG. 7.

As shown in FIGS. 7 and 8, the disk section 6*c* is provided with a fitting hole 6*g* at the approximate center thereof for fitting to the eyelet portion 4*a* of the variable-side terminal 4. After the eyelet portion 4*a* of the variable-side terminal 4 is fitted into the fitting hole 6*g*, the sliding contact 6 is rotatably attached to the insulating substrate 1 by outwardly caulking the eyelet part 4*a*.

The sliding contact 6 is made of a thin metallic plate having high conductivity and spring characteristics, such as those made of a copper alloy, stainless steel, and a noble metal alloy.

To change the resistance of the variable resistor, the sliding contact 6 is rotated by inserting the edge of a Phillips screwdriver, for example, into the engagement hole 6*b*. Thereby, the resistance between the stationary-side terminal 2 (or 3) and the variable-side terminal 4 is changed.

In the variable resistor, as shown in FIG. 3, since the step 6*e* increases the gap T1 between the driver plate 6*a* and the contact arm 6*d* in size, even if the height of the disk section 6*c* is reduced so as to reduce the height of the variable resistor, the contact 6*f* of the contact arm 6*d* does not contact the driver plate 6*a*. Accordingly, contact between the driver plate 6*a* and the contact arm 6*d* caused by errors in manufacturing the sliding contact 6 and the insulating substrate 1 is reliably prevented. As a result, the contact pressure between the contact 6*f* of the contact arm 6*d* and the resistor 5 is stabilized, which suppresses fluctuations in electrical characteristics (changes in resistance). Also, when the step 6*e* is formed by coining, the strength of the driver plate 6*a* is increased by work hardening.

The depth T2 of the step 6*e* is set to a size such that the driver plate 6*a* is not in contact with the contact arm 6*d* in view of allowances of the sliding contact 6 and the insulating substrate 1 in the height direction. For example, in a variable resistor with an external size of about 2.7 mm by about 2.1 mm and a height of about 0.8±0.05 mm, if the thickness T5 of the insulating substrate 1 is about 0.5 (+0.03/−0.05) mm, the thickness T4 of a metallic plate of the sliding contact 6 is about 0.1 mm, the gap T3 between the top surface of the insulating substrate 1 and the sliding contact 6 is about 0.1 mm, and the thickness of the resistor 5 is about 0.02 mm, preferably, the depth T2 of the step 6*e* is about 0.03 mm while the gap T1 between the driver plate 6*a* and the contact arm 6*d* at the contact 6*f* is about 0.08 mm.

Second Preferred Embodiment

Figure 9:
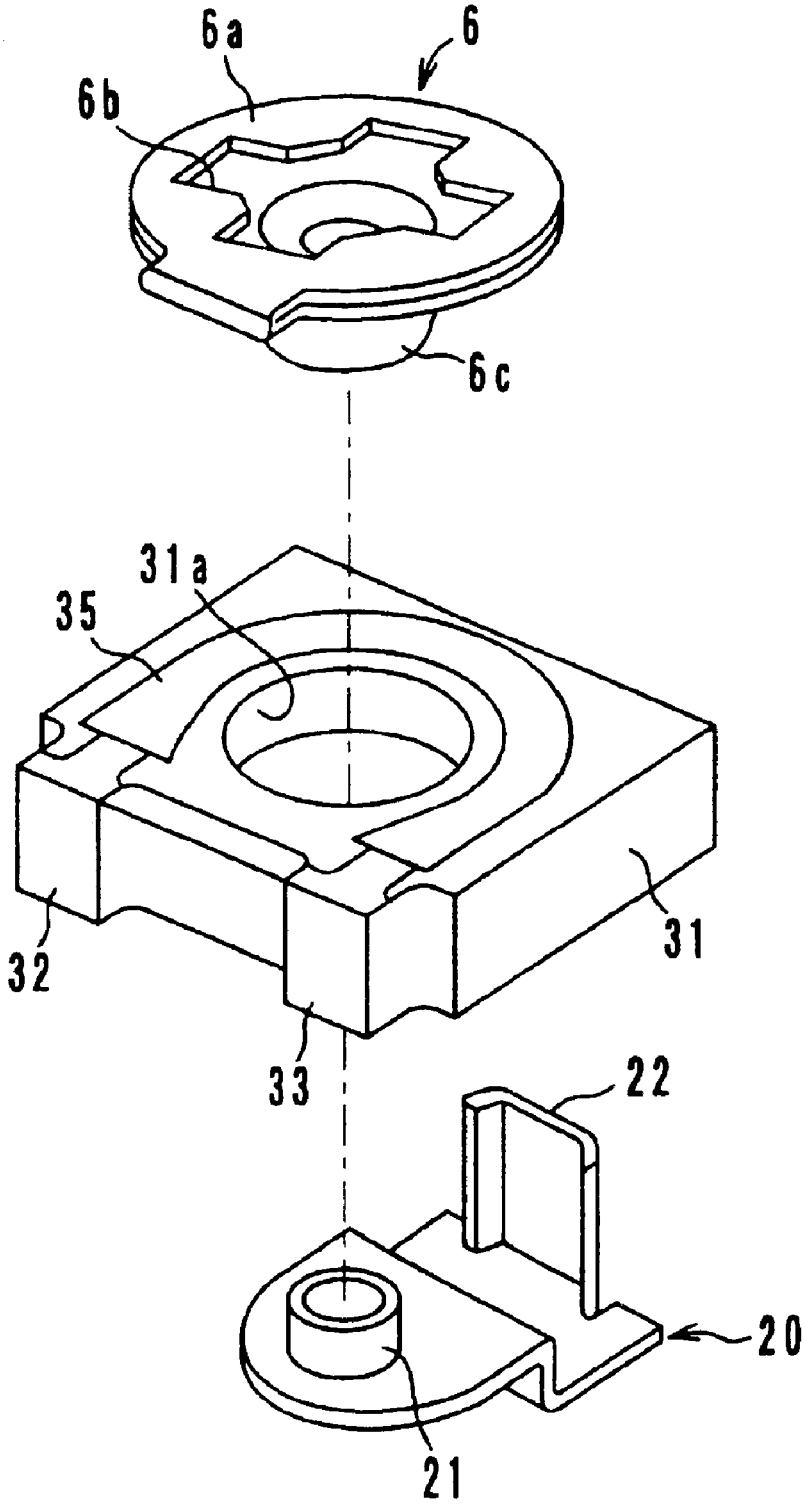
FIG. 9 is a perspective assembly view of a variable resistor according to a second preferred embodiment of the present invention.

FIG. 9 is an exploded perspective view of a variable resistor according to a second preferred embodiment. This variable resistor includes a ceramic insulating substrate 31, a metallic variable-side terminal 20, and the metallic sliding contact 6 attached to the variable-side terminal 20, for example, by caulking. Since the sliding contact 6 is the same as in the first preferred embodiment, the detailed description thereof is omitted.

The insulating substrate 31 is obtained by baking a ceramic material such as alumina which is formed in advance. The top surface of the insulating substrate 31 is coated with cermet in a substantially arch-shaped arrangement about a central hole 31*a*, and the cermet is dried so as to form a resistor 35. At both ends of the resistor 35, external electrodes 32 and 33, which are formed from side surfaces to the back surface of the insulating substrate 31, are connected. The external electrodes 32 and 33 are formed by printing, sputtering, or vapor deposition or other suitable process.

After an eyelet portion 21 of the variable-side terminal 20, which is inserted into a central hole 31*a* of the insulating substrate 31, is fitted into the fitting hole 6*g* provided at the approximate center of the disk section 6*c*, the sliding contact 6 is rotatably attached to the insulating substrate 31 by outwardly caulking the eyelet part 21. At one end of the variable-side terminal 20, a stopper 22 is arranged so as to be upwardly folded along a side surface of the insulating substrate 31.

The variable resistor as described above has the same functions and advantages as those of the first preferred embodiment.

Figure 10:
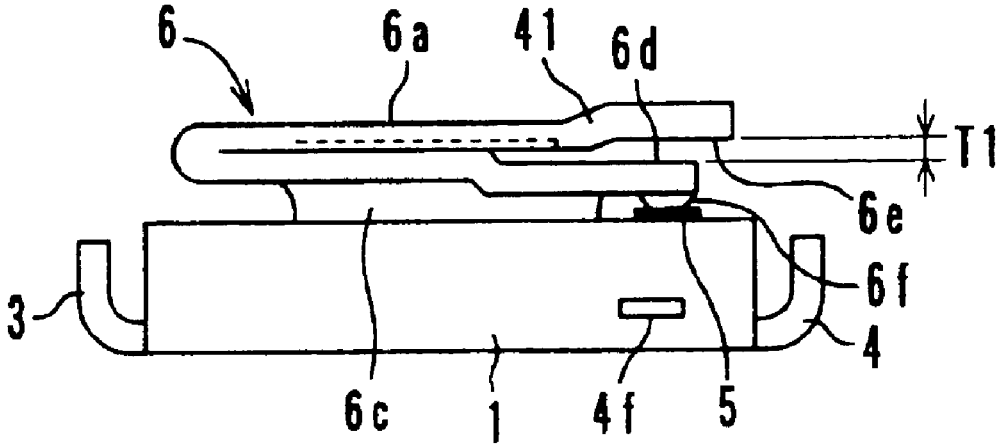
FIG. 10 is a side view showing another preferred embodiment.
Figure 11A:
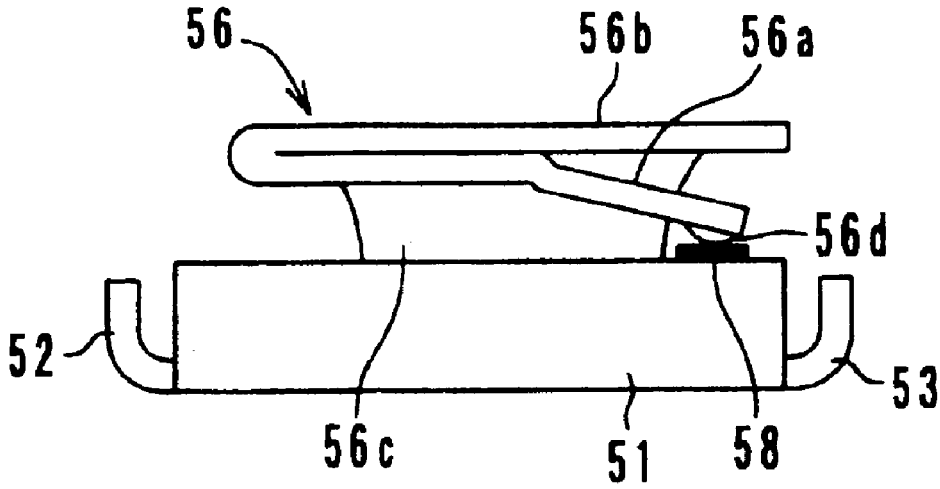
FIG.11A PRIOR ART
FIGS. 11A and 11B are side views of a conventional variable resistor.
Figure 11B:
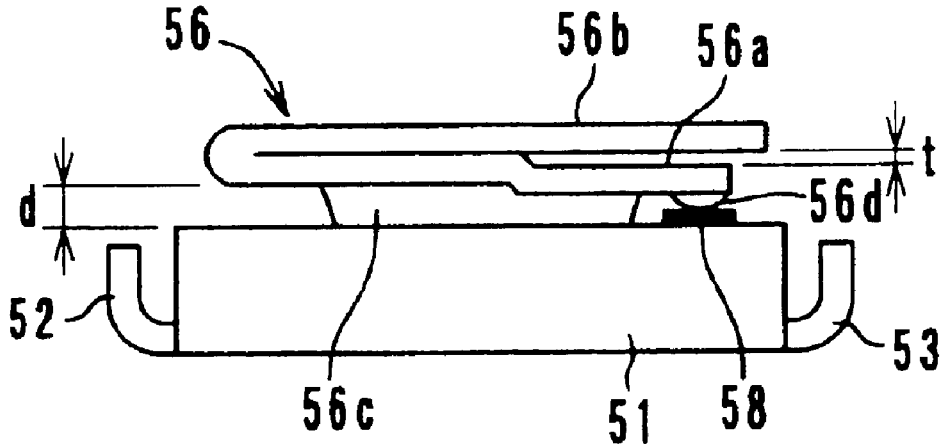
FIG.11B PRIOR ART

The present invention is not limited to the preferred embodiments described above, and various modifications can be made within the scope of the invention. For example, as long as the step 6*e* on the back surface of the driver plate 6*a* prevents contact of the contact arm 6*d* at the contact 6*f*, the step 6*e* may have any shape. Also, the step 6*e* may be formed by coining or etching, alternatively, as shown in FIG. 10, it may be formed by providing a folding part 41 in the driver plate 6*a*.

The present invention is not limited to each of the above-described preferred embodiments, and various modifications are possible within the range described in the claims. An embodiment obtained by appropriately combining technical features disclosed in each of the different preferred embodiments is included in the technical scope of the present invention.

What is claimed is:

1. A variable resistor comprising:

an insulating substrate having a substantially arch-shaped resistor provided on a surface thereof; and a sliding contact rotatably attached to the insulating substrate; wherein the sliding contact includes a body including a contact arm sliding over the resistor and a disk section for supporting the contact arm and a driver plate overlapping the body for being operated by a tool;

a step disposed in a portion of the driver plate opposing a contact of the contact arm such that a gap between the portion of the driver plate having the step disposed therein and the contact arm is greater than a gap between a portion of the driver plate not having the step disposed therein and the contact arm;

the portion of the driver plate having the step disposed therein has a thickness that is less than a thickness of the remainder of the driver plate, the thicknesses being defined as a distance between upper and lower major surfaces of the driver plate.

2. A variable resistor according to claim 1, wherein the step is defined by a recess provided in the driver plate.

3. A variable resistor according to claim 1, wherein the insulating substrate is made of at least one of a thermoplastic resin and a thermo-setting resin.

4. A variable resistor according to claim 1, further comprising stationary-side terminals provide on a top surface of the insulating substrate such that conduction portions of the stationary-side terminals are exposed.

5. A variable resistor according to claim 4, wherein the resistor is defined by carbon coated on a top surface of the insulating substrate in a substantially arch-shaped configuration so as to cover the conduction portions of the stationary-side terminals.

6. A variable resistor according to claim 4, wherein the stationary-side terminals are made of a highly conductive material, and the stationary-side terminals are plated with a noble metal to improve solder wettability.

7. A variable resistor according to claim 1, wherein the driving plate includes a substantially cross-shaped engagement hole for being operated by the tool.

8. A variable resistor according to claim 1, wherein the contact arm has a semi-circular shape.

9. A variable resistor according to claim 1, wherein the disk section is folded backwards from an external edge of the driving plate.

10. A variable resistor according to claim 9, wherein the contact arm is provided at an external edge of the disk section opposite to the portion of the disk that is folded backwards from the external edge of the driving plate.

11. A variable resistor according to claim 1, wherein the sliding contact is made of a highly conductive material having spring characteristics.

12. A variable resistor according to claim 1, further comprising a variable-side terminal including an eyelet portion, wherein the disk section is provided with a fitting hole at an approximate center thereof for fitting to the eyelet portion of the variable-side terminal.

13. A variable resistor according to claim 12, wherein the sliding contact is rotatably attached to the insulating substrate by outwardly caulking the eyelet portion of the variable-side terminal.

14. A variable resistor according to claim 1, wherein the contact arm includes a protruding contact provided at an approximate center thereof, such that the contact is brought into contact with the resistor.

15. A variable resistor according to claim 1, wherein the insulating substrate is a ceramic insulating substrate.

16. A variable resistor according to claim 15, wherein a top surface of the ceramic insulating substrate is coated with cermet in a substantially arch-shaped configuration to define the resistor.

* * * * *